US006474519B1

(12) United States Patent
Cleveland

(10) Patent No.: US 6,474,519 B1
(45) Date of Patent: Nov. 5, 2002

(54) CAULKING GUN HOLSTER WITH TOOL PUNCH

(75) Inventor: Kenneth Dale Cleveland, LaMarque, TX (US)

(73) Assignee: Kenneth D. Cleveland, La Marque, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/699,930

(22) Filed: Oct. 30, 2000

(51) Int. Cl.[7] ..... A45F 5/00

(52) U.S. Cl. ..... 224/251; 224/677; 224/679; 224/904; 224/269; D3/228

(58) Field of Search ..... 224/148.7, 235, 224/251, 249, 904, 673, 677, 678, 679, 269; 220/571; D3/228; 215/399

(56) References Cited

U.S. PATENT DOCUMENTS 2,756,912 A * 7/1956 Armstrong
3,021,101 A 2/1962 Gliebe
3,201,018 A * 8/1965 Moody
3,343,735 A 9/1967 Breeding
4,830,247 A * 5/1989 Banks
5,301,857 A * 4/1994 Green
D409,381 S * 5/1999 Cleveland et al. ..... D3/228
6,325,261 B1 * 12/2001 Webber ..... 224/251

* cited by examiner

*Primary Examiner*—Gregory M. Vidovich
(74) *Attorney, Agent, or Firm*—Buskop Law Group, P.C.; Wendy Buskop

(57) ABSTRACT

A holster for containing a sealant caulk gun heaving a tip comprising:

a strap having a first end and a second end, a clip with a tongue formed in the first end for attaching or disengaging from another object;

a body connected to the second end of the strap further comprising a first body end with a guide horn and a second body end having a second body end opening and an elongated nose connected to the second body end;

the elongated nose further having an opening disposed therein in communication with the second body end opening for receiving the tip of the sealant/caulk gun; and a cap detachably secured to the elongated nose; and a tool holder.

18 Claims, 6 Drawing Sheets

CAULKING GUN HOLSTER WITH TOOL PUNCH

FIELD OF THE INVENTION

The present invention is, in general, a belt-suspended holder for tools and, more specifically, is a holster for holding caulking guns therein.

BACKGROUND OF THE INVENTION

Many tools are used under conditions which make it inconvenient for the user to keep them in hand or to set them aside when they are not actually in use. The well-known caulking gun is one of these. In addition, the dripping of caulking compound from the tool during non-use represents a problem because it so easily can wind up on the hands or clothes of the user, or on the floor where it becomes a safety hazard to others, and can be tracked to other locations.

Apparently, little has been done to alleviate this problem. Of course, there are many belt-suspended holders for tools in general, but few, if any, address the special problems posed by caulking guns. The following patents address belt-suspended holders of tools, and only one addresses a holster for a caulking gun.

Martin Swiss Pat. No. 250,232, published May 18, 1948, discloses a belt from which are suspended, by loops, a number of sheaths into which are inserted various kinds of materials and tools. Except for illustrating the concept of suspension by loops from a belt, Martin has no bearing on the present invention.

Henrion French Pat. No. 1,077,958, published Nov. 15, 1954, discloses a sheath or scabbard having a protective tip thereon, for suspending files or the like slim pointed objects from a belt, and providing for the tip to be fastened to a wearer's thigh. Except for the protective tip to cover the points, Henrion has no bearing on the present invention.

Gliebe U.S. Pat. No. 3,021,101, issued Feb. 13, 1962, discloses a holder for a fishing rod, said holder being held on a belt by a sheath. Gliebe's only relationship to the present invention is to disclose a sheath suspended from a belt.

Breeding et al U.S. Pat. No. 3,343,735, issued Sept. 26, 1967, discloses a holster for a mason's trowel, designed to be adaptable to a range of sizes thereof. Other than being a holster to suspend a tool from a belt, it has no relationship to the present invention.

Rosenkaimer U.S. Pat. No. 4,114,787, issued Sept. 19, 1978, discloses a scabbard for a knife which can be attached to a belt without unfastening the belt. Other than disclosing one method of removably attaching a belt clip over a belt, there is no relationship to the present invention.

Pattermann U.S. Pat. No. 4,300,708, issued Nov. 17, 1981, discloses a scabbard or sheath for a drywall taper's knife. Pattermann has no relationship to the present invention.

Tuthill U.S. Pat. No. 4,496,088, issued Jan. 29, 1985, discloses a sportsman's sheath for holding a pair of pliers and a knife. There is no relationship to the present invention.

Litman U.S. Pat. No. 4,588,116, issued May 13, 1986, discloses a holster for holding a tear-gas projector on the belt. Other than disclosing a receptacle for holding the projector, there is no relationship to the present invention.

Devine U.S. Pat. No. 5,232137 issued Aug. 3, 1993 discloses a holster for carrying a spray can with a receptacle for receiving the end of the spray can.

Byrd U.S. Pat. No. 5,385,281 issued Jan. 31, 1995 discloses a painter's utility belt which has a variety of loops, one of which can secure a section of PVC pipe or the like to provide for the storage of a caulking gun.

Banks U.S. Pat. No. 4,830,247 issued May 16, 1989 discloses a holster for a caulking gun supported from a belt having a nose plate, a clasp and a cutting element and a wire element for opening the caulking gun.

The only relationships to the present invention which are disclosed in the foregoing references are those which are old in the art, and which do not anticipate or suggest, either singly or in combination, the novel improvements of the present invention which uniquely has an anti-drip mechanism on the end, a detachable belt clip means, and a carrying pouch for additional tools.

BRIEF DESCRIPTION OF THE PRESENT INVENTION

The present invention is a hands-free "holster" for a caulking "gun", which is comprised of a strap, which can be suspended from a belt and having a first end and a second end. The first end of the strap is made in the form of a clip which can be removably attached to a belt by sliding over the belt edge without lacing through the belt. The invention further comprises a body secured to the second end of the strap for holding the caulking "gun," having a first body end with a guide horn secured to the body opposite the side the strap secures to the body and a second body end with an opening and elongated nose with an opening in communication with the opening in the second body end. On the second body end, the opening receives the tip of the caulking "gun" once the gun is inserted in the holster, and the elongated nose then surrounds the tip. The elongated nose has a removably detachable cap which can be secured to the elongated nose to prevent caulk from spraying or spattering the user or surrounding environment. The holster incorporates means for holding additional tools, such as a blade for cutting the caulking tip, measuring devices, scrapers, rags and pencils.

One of the benefits and objectives of the invention is that it frees the user's hands to perform other tasks except when actually engaged in caulking.

Other benefits and objectives will become apparent as the detailed description and the drawings are studied.

DETAILED DESCRIPTION OF THE PRESENT INVENTION

Figure 1:
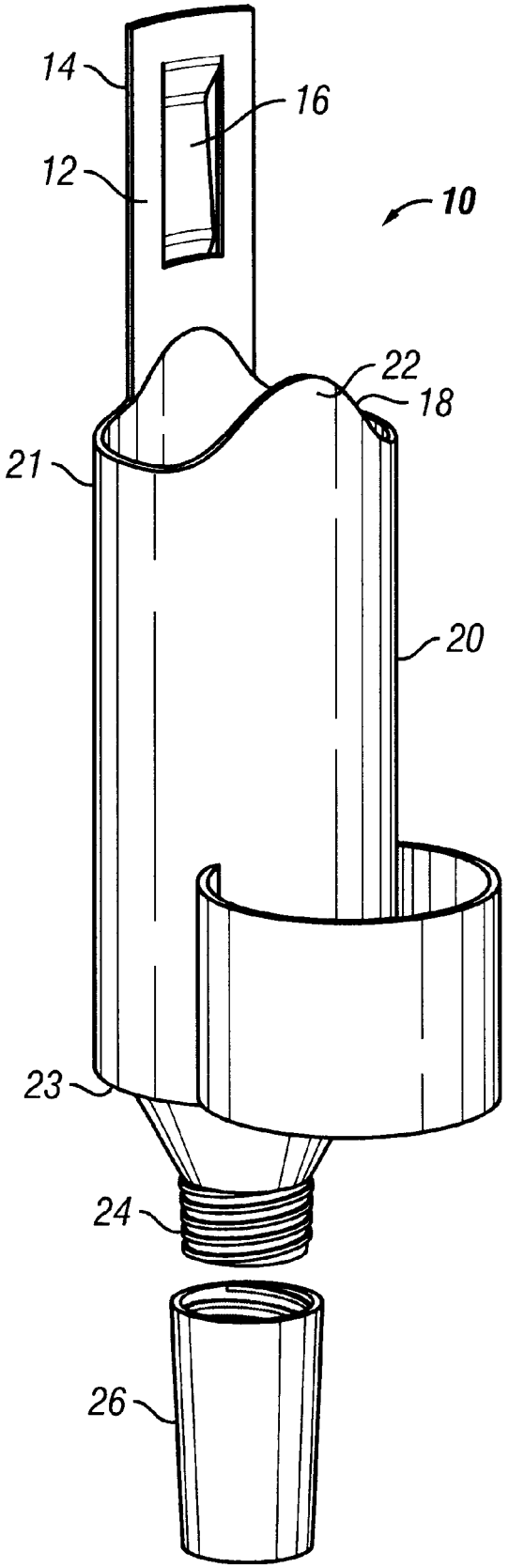
FIG. 1 is a perspective view of the present invention.

FIG. 1 depicts holster 10, which comprises a strap 12 having a preferred width of 3 inches and which can range from 2 to 4 inches. The strap 12 has a first end 14 which can be secured to a belt. The first end 14 is formed into a clip 16 which can be easily attached or disengaged from a belt.

The strap 12 has a second end 18 which is secured to the body 20 of the holster 10. The body has a first body end 21 with a guide horn 22 and a second body end 23 which is secured to an elongated nose 24. The elongated nose 24 has a cap 26 for detachably covering the end of the elongated nose. The second body end 23 is preferably a plate for retaining the body of the sealant gun, having a round shape with a round opening disposed in the center of the plate. The opening is preferably 1.75 inches in diameter, but can range from 0.75 to about 3 inches.

Figure 2:
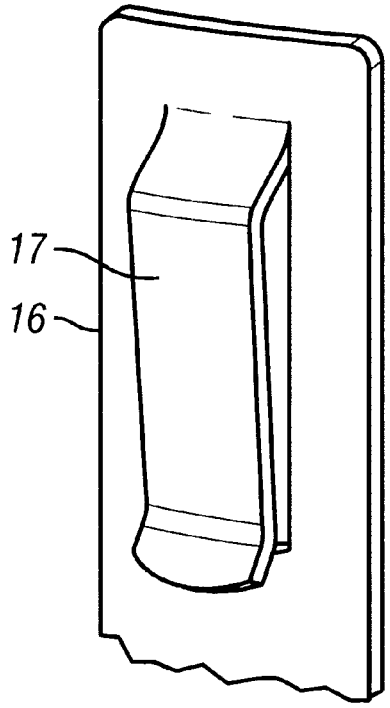
FIG. 2 is a detailed view of the clip.

FIG. 2 shows clip 16 with a tongue 17 cut out of the same material as strap 12. The tongue 17 is preferably from 2.5 to 5 inches long and from 1 to 2 inches wide. In the most preferred embodiment, the length of the tongue is 4 inches and the width of the tongue is 1.5 inches. Other clip constructions such as a loop of material are contemplated to work within the scope of this invention.

Figure 3:
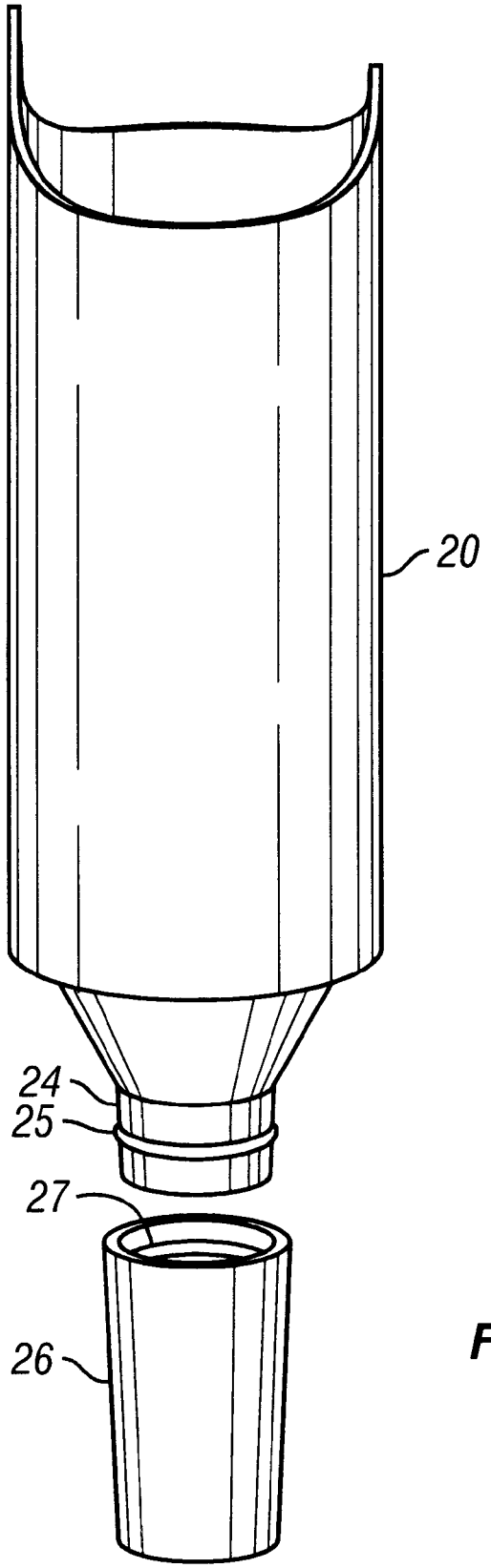
FIG. 3 is a view of an embodiment of the cap attached to the elongated nose.
Figure 4:
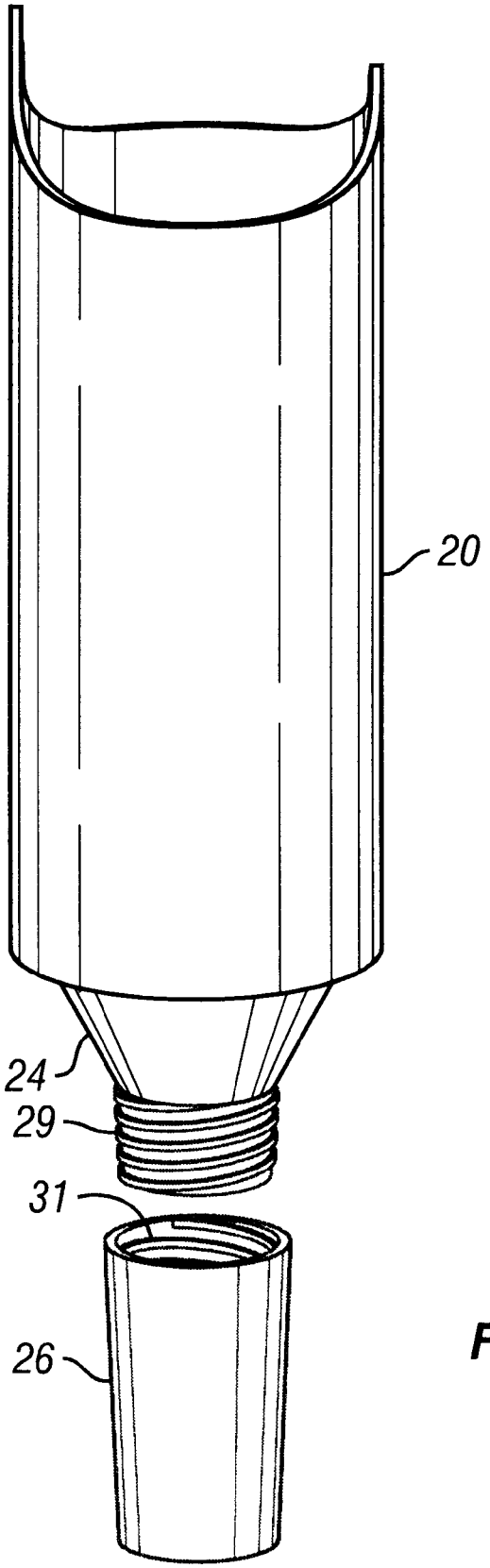
FIG. 4 is a view of another embodiment of the cap attaching means to the elongated nose.

In FIG. 3, the elongated nose 24 may have an additional O-ring 25 disposed on the outer surface of the elongated nose and the cap 26 can snap onto the nose over the O-ring with the O-ring engaging interior groove 27. Alternatively, as shown in FIG. 4, the elongated nose 24 can have threads 29 disposed on the outer surface of the elongated nose 24 and on the inner surface 31 of cap 26 for a threaded engagement as shown in FIG. 4. The elongated nose has a second opening with a diameter ranging from 0.5 to 3.0 inches or, more specifically, a diameter ranging from 0.9 to 1.7 inches.

Figure 5:
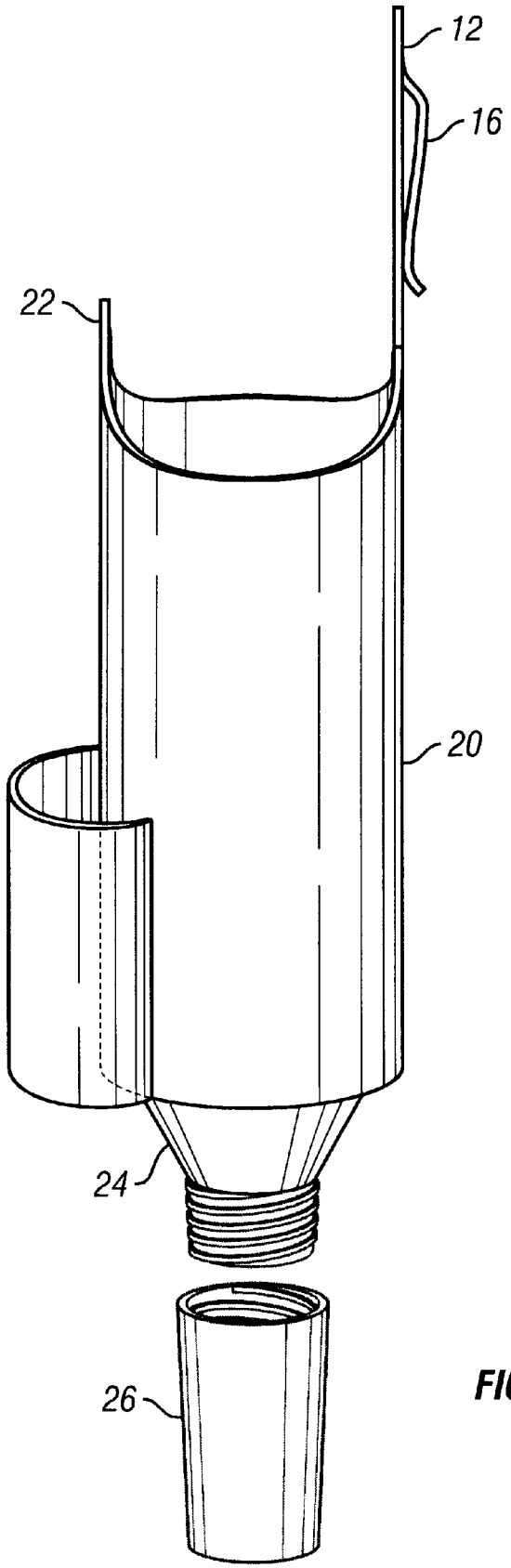
FIG. 5 is a view of the tool holder on the body of the holster.
Figure 6:
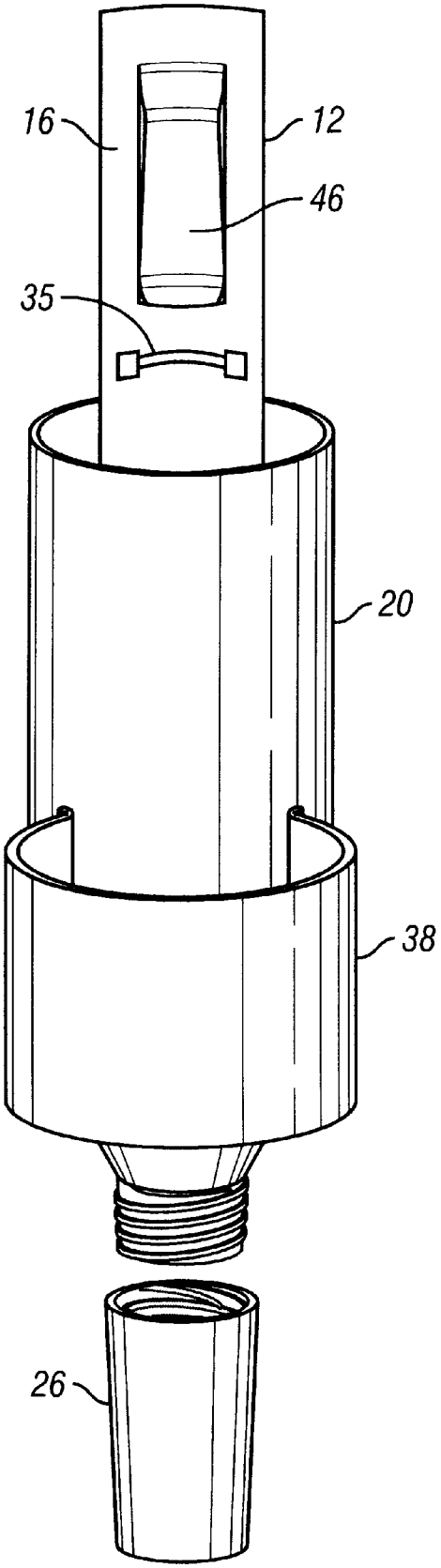
FIG. 6 is a view of the invention with a restraining means attached to a strap.

As shown in FIG. 5, the body 20 preferably has a length from the strap to elongated nose of from 4 to 12 inches depending on the length of the guide horn that is used. The guide horn 22, in the most preferred embodiment has a length of 2 inches with a corresponding body length of 9 inches. Shorter body lengths work within the scope of the invention with longer guide horn lengths; however, with a short guide horn, a restraining strap would be needed to keep the caulking gun in the holster. A "hornless" version of the holster could be used within the scope of this invention, and a version with restraining strap 35 is shown in the embodiment of FIG. 6.

The body 20 can have various body shapes which work within the scope of the invention. In one embodiment, the body shape is a tapered cone, with the larger diameter on said first body end 21 and a smaller diameter on the second body end 23. However, in the preferred embodiment, the shape of body 20 is an oval shape at the first body end 21, tapering to a round shape at the second body end 23. Preferably, the diameter of the body 20 decreases from the first body end with a diameter of 3.9 inches to a diameter of 2.9 inches at the second body end.

In the most preferred embodiment, the second body end 23 will have a planar surface from which the elongated nose 24 extends. It is contemplated that the elongated nose may be removable from body 20 and remain within the scope of the invention.

The elongated nose 24 is contemplated to preferably be a tapered conical construction most preferably at least 0.5 inches long, and can extend to up to 6 inches long. In the most preferred embodiment, the nose is 2 to 3 inches in length.

As shown in FIG. 6, the clip 16 is integral with strap 12 and formed from the material as strap 12. The clip 16 has a tongue 46 cut from the strap 12, in a shape which is generally rectangular with a rounded end. In an alternative embodiment, a portion of the strap 12 can be cut away from the sides of the tongue 46 creating a gap around said tongue enabling easier engagement and detachment of the clip 16 to a belt or parts of a worker's clothes or even to a ladder or other object in the area of work.

The strap 12 is preferably 7 inches long from the top of the clip to the body, but the length can vary to be as long as practicable up to 10 inches and as short as 2.5 inches, so long as the length does not permit the holster to drag on the ground.

It is contemplated to be within the scope of the invention to use a strap 12 constructed with a thickness greater than the thickness of the material used for the body 20 which enables the strap to rigidly support the body while still containing the caulking gun. The most preferred thickness of the body material is 0.12 inches and the most preferred thickness for the strap is 0.25 inches.

Body 20 and strap 12 can be fabricated of any of several materials, for example, PVC, ABS plastic, and low density polyethylene, as long as the material is durable and capable of being fabricated in the form described. Preferably the body, clip, strap and elongated nose are of a one-piece, molded body construction. The holster can be made from a member of the following group: low density polyethylene, PVC, ABS plastic, rubber, coated metal screening material, laminates and combinations thereof.

ABS can be obtained from Regal Plastics Supply Co. of 1700 Wirt Road, Houston, Tex. The low density polyethylene can be PE2061 available from Lyondell Polymers of Houston, Tex.

Guide horn 22 can a simple triangular-shaped plate or rounded triangular shaped plate against which the caulk gun rests, so that the caulk gun does not swing out in the holster and scratch furniture or hit objects. The guide horn 22 is critical to guide the gun into the holster and keep the gun from moving around and rotating into the holster. The guide horn can be useful in other shapes, such as a D-shape, a half moon shape, an inverted "V" shape or a similar shape.

The holster is contemplated for use with many kinds of sealants and caulks, including, but not limited to, silicones, roof sealants, butyl flex, concrete and mortar filler and sealer, marine adhesives, marine sealants, glues, construction adhesives, window glazing compounds, and black top asphalt filler and sealant.

Holster 10 may optionally include a tool holder means 38 for holding tools.

Tool holder 38 can be used to hold a blade, a scraper, pencil, screwdriver, cigarettes, beef jerky, a putty knife, a rag, a twinkie, or a measuring device and related tools used for caulking, painting and sealing projects.

The tool holder attached to the body 20 has a preferred length of 4 inches, a depth of 1 inch and a width of 4 inches. However, the tool holder can range in size from a length of 2.5 inches to 5 inches, a depth of 0.5 inches to 2.0 inches, and a width of between 2 to 6 inches. The tool holder fits the contour of the holster and is preferably made of a somewhat flexible material.

It is within the scope of the invention to have multiple tool holders, secured to the body 20, each having a width of about two inches and identical heights and depths.

Figure 7:
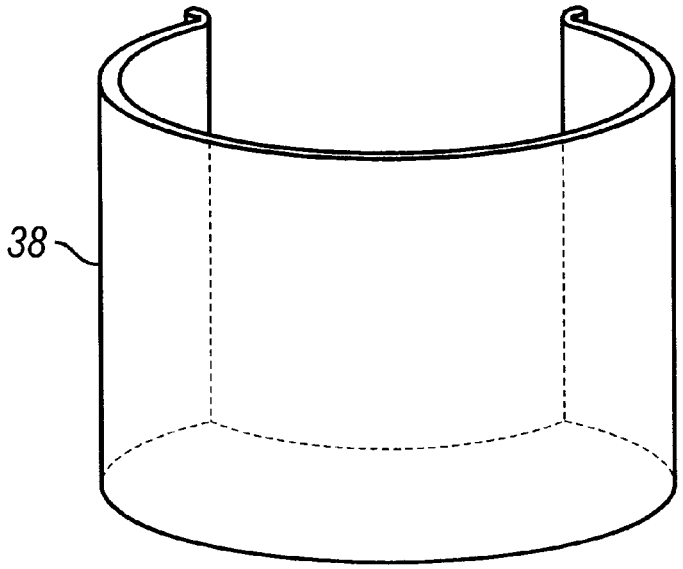
FIG. 7 is a detailed view of the slidable embodiment of the tool holder of the invention.

The tool holder can be glued on to the body 20 or made integral with the body as part of the one-piece construction. Alternatively, as shown in FIG. 1 and FIG. 7, the tool holder can slide onto the body 20. In this version, the body would have grooves created in a parallel relationship on the outer surface of the body (shown in FIG. 1), and the pouch would be a one-piece material with flared edges as shown in FIG. 7 which would engage those grooves.

The method for using the invention would proceed as following,

The holster 10 would be secured to the belt of the user by clip 16. Strap 12 then hangs down alongside the user's leg. The applicator tip of a caulking gun would be inserted into body 20 and further into elongated nose 24. The cap 26 is attached to the elongated nose 24 to stop drips.

After caulking, the cap 26 can be removed, the holster 10 and cap 26 cleaned out for the next use. No build up of caulk would occur with the invention.

It will be apparent to those skilled in the art that many modifications in form and structure could be made in the present invention without departing from the spirit or intent thereof.

The terms and expressions which have been employed in the foregoing specification are used therein as terms of description and not of limitation, and there is no intention, in the use of such terms and expressions, of excluding equivalents of the features shown and described, or portions thereof, it being recognized that the scope of the invention is defined and limited only by the claims which follow.

What is claimed is:

1. A holster for containing a sealant caulk gun heaving a tip comprising:

a strap having a first end and a second end, a clip with a tongue formed in said first end for attaching or disengaging from another object;

a body connected to said second end of said strap further comprising a first body end with a guide horn, and a second body end comprising a plate for retaining the body of the sealant caulk gun and an opening for receiving the tip of the sealant/caulk gun, and an elongated nose connected to said second body end;

said elongated nose further having an opening disposed therein in communication with the second body end opening for receiving said tip of said sealant/caulk gun;

a cap detachably secured to the elongated nose; and a tool holder for containing at least one member selected from the group: a blade, a putty knife, a scraper, a screwdriver, beef jerky, cigarettes, a twinkie, a measuring device, a pencil, and a rag.

2. The holster of claim 1, wherein said strap, clip, body and elongated nose is a one piece molded construction.

3. The holster of claim 1, wherein said object is the belt of a construction worker.

4. The holster of claim 1, wherein said second opening has a diameter ranging from 0.5 to 3.0 inches.

5. The holster of claim 4, wherein said second opening has a diameter of between 0.9 to 1.7 inches.

6. The holster of claim 1, wherein said cap is cylindrical.

7. The holster of claim 1, wherein said elongated nose further comprising an O-Ring disposed on the outer surface of said nose, and said cap further comprises a shape which covers said nose and a grooved interior portion enabling said cap to snap over said elongated nose.

8. The holster of claim 1, wherein said elongated nose further comprises a threaded outer surface and said cap comprises a threaded inner surface enabling a threaded engagement between said elongated nose and said cap.

9. The holster of claim 1, wherein said guide horn is triangular in shape.

10. The holster of claim 1, wherein the body has a length from the first end to the second end from 7 inches to 9 inches.

11. The holster of claim 1, wherein said body has a tapered conical shape.

12. The holster of claim 1, wherein said body at said first body end has an oval shape and at said second body end has a round shape.

13. The holster of claim 1, wherein said elongated nose is between 2 to 3 inches in length.

14. The holster of claim 1, wherein said clip consists of a tongue cut from said strap.

15. The holster of claim 1, wherein said strap has a thickness greater than the thickness of the body.

16. The holster of claim 1, wherein said holster is made from a member of the group: low density polyethylene, PVC, ABS, plastic, rubber, coated metal screening material, laminates and combinations thereof.

17. The holster of claim 1 for use with a member of the group: silicone, roof sealant, butyl flex, concrete and mortar filler and sealer, marine adhesives, caulk, glues, construction adhesives, window glazing, blacktop asphalt filler and sealant, and marine sealants.

18. The holster of claim 1, wherein said tool holder is slidably engaged to said body.

* * * * *